US009721523B2

(12) United States Patent
Shin et al.

(10) Patent No.: US 9,721,523 B2
(45) Date of Patent: Aug. 1, 2017

(54) DRIVING DEVICE OF DISPLAY DEVICE

(71) Applicant: Samsung Display Co., Ltd., Yongin (KR)

(72) Inventors: Ok-Kwon Shin, Asan-si (KR); Won Tae Kim, Cheongju-si (KR); Sun Kyu Son, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 864 days.

(21) Appl. No.: 13/733,690

(22) Filed: Jan. 3, 2013

(65) Prior Publication Data

US 2014/0062985 A1 Mar. 6, 2014

(30) Foreign Application Priority Data

Sep. 3, 2012 (KR) ..... 10-2012-0097229

(51) Int. Cl.
*G09G 3/36* (2006.01)

(52) U.S. Cl.
CPC ..... *G09G 3/3696* (2013.01); *G09G 3/3677* (2013.01); *G09G 2320/0247* (2013.01)

(58) Field of Classification Search
CPC ..... G09G 2320/0233; G09G 3/3406; G09G 3/3677; G09G 3/3696; G09G 2320/0247; H05B 33/0827
See application file for complete search history.

(56) References Cited

U.S. PATENT DOCUMENTS 6,421,038 B1 * 7/2002 Lee ..... G09G 3/3677 345/87
7,499,015 B2 3/2009 Daum et al.
8,188,951 B2 5/2012 Im
2002/0080110 A1 6/2002 Kim et al.
2005/0057480 A1 3/2005 Liao et al.
2007/0008255 A1 * 1/2007 Emek ..... H05B 33/0827 345/82

(Continued)

FOREIGN PATENT DOCUMENTS

KR 10-2006-0060969 6/2006
KR 10-2006-0106322 10/2006

(Continued)

*Primary Examiner* — Nicholas Lee
*Assistant Examiner* — Richard Hong
(74) *Attorney, Agent, or Firm* — H.C. Park & Associates, PLC

(57) ABSTRACT

A driving device of a display apparatus includes: a gate driver, a gate on voltage modulator, and a signal controller. The gate driver includes a plurality of gate driving circuits, each of the gate driving circuits being configured to: generate a gate signal according to a gate control signal, and apply the gate signal to at least one gate line. The gate on voltage modulator is configured to: modulate a gate on voltage according to a modulation control signal, and generate a first modulated gate on voltage. The signal controller is configured to generate the modulation control signal and the gate control signal. At least one of the plurality of gate driving circuits includes an amplifier configured to: receive the first modulated gate on voltage, and output a second modulated gate on voltage including substantially the same waveform as the first modulated gate on voltage.

19 Claims, 13 Drawing Sheets

(56) References Cited

U.S. PATENT DOCUMENTS

| | | | | |
|---|---|---|---|---|
| 2008/0122768 | A1* | 5/2008 | Jung | G09G 3/3674 345/87 |
| 2009/0147030 | A1 | 6/2009 | Choi et al. | |
| 2011/0057968 | A1 | 3/2011 | Kim et al. | |

FOREIGN PATENT DOCUMENTS

| | | |
|---|---|---|
| KR | 10-2007-0043360 | 4/2007 |
| KR | 10-2010-0074369 | 7/2010 |
| KR | 10-0983753 | 9/2010 |
| KR | 10-1021747 | 3/2011 |
| KR | 10-1085143 | 11/2011 |

* cited by examiner

DRIVING DEVICE OF DISPLAY DEVICE

CROSS-REFERENCE TO RELATED APPLICATION

This application claims priority from and the benefit of Korean Patent Application No. 10-2012-0097229, filed on Sep. 3, 2012, which is incorporated by reference for all purposes as if set forth herein.

BACKGROUND

Field

Exemplary embodiments relate to display technology, and more particularly to driving devices for display devices.

Discussion

In general, a display device includes a plurality of pixels (i.e., units for displaying images) and a plurality of drivers configured to drive the plurality of pixels.

Individual ones of the plurality of pixels are connected with corresponding ones of a plurality of gate lines and data lines. Each pixel may include a switching element, such as a thin film transistor, connected to corresponding ones of the plurality of gate lines and data lines. At least one pixel electrode is typically connected thereto. The plurality of gate lines and data lines may extend in different directions, and may cross each other, such as in a perpendicular (or substantially perpendicular) manner.

The plurality of drivers usually include a data driver configured to apply one or more data voltages to the plurality of data lines, a gate driver configured to apply one or more gate signals to the plurality of gate lines, and a signal controller configured to apply one or more control signals to the gate driver and the data driver to, thereby, control the gate driver and the data driver. In this manner, the signal controller is configured to control driving timings of the gate driver and the data driver, as well as configured to supply an image signal to the data driver.

The gate driver may include a shift register that, in turn, includes a plurality of stages that are subordinately connected to each other or at least one gate driving circuit. The gate driver is configured to receive a plurality of driving voltages and a plurality of gate control signals to generate gate signals. The plurality of driving voltages may include a gate on voltage configured to turn on corresponding switching elements and a gate off voltage configured to turn off the corresponding switching elements. The plurality of gate control signals may include a scanning start signal STV configured to instruct a scanning start, a gate clock signal CPV configured to control an output timing of a gate on pulse, and the like. The gate driver is configured to output gate on pulses to the plurality of gate lines in sequence.

The data driver is configured to apply the plurality of data voltages to the plurality of data lines whenever a gate on pulse is applied to a gate line so that a corresponding data voltage may be applied to a respective pixel via a corresponding switching element.

When the gate off voltage is applied to the thin film transistor, which is the switching element of each pixel, to turn off the thin film transistor, a voltage applied to each pixel may be changed according to one or more corresponding voltage changes associated with a parasitic capacitor of the thin film transistor and the gate signal. The voltage change is referred to as a kickback voltage. A flicker and/or other image distortions may be caused by deviations in the kickback voltage and, as such, image quality may be deteriorated. As a size of the display device becomes larger, a data charging time of the thin film transistor may be insufficient due to a delay of the gate on pulse caused by a load of the gate line. This too may cause image distortions or degradations.

Conventionally, the above-noted problems have been addressed by modifying the gate on voltage to generate the plurality of gate signals.

As display panels of display devices become larger, signal wires (or lines) configured to transfer the plurality of driving voltages and the plurality of gate control signals input to the gate driver are becoming longer and, as such, distortion in waveforms of the plurality of driving voltages and the plurality of gate control signals may result due to the load on the plurality of signal wires. As a result, a deviation in a level and a waveform of a gate on pulse may occur according to a position of the gate driving circuit, and a boundary between display areas corresponding to two gate driving circuits may be perceived by an observer. As such, image quality of the display device may become deteriorated.

Therefore, there is a need for an approach that provides efficient, cost effective techniques to drive display devices that can reduce (or otherwise prevent) deviations in the waveforms of gate-on pulses and, thereby, reduce (or otherwise prevent) image quality distortions or degradations.

The above information disclosed in this Background section is only for enhancement of understanding of the background of the invention and, therefore, it may contain information that does not form any part of the prior art nor what the prior art may suggest to a person of ordinary skill in the art.

SUMMARY

Exemplary embodiments provide a driving device of a display apparatus and an associated method to drive the display apparatus, which is configured to prevent (or otherwise reduce) deviations in a waveform of a gate on pulse output from a plurality of gate driving circuits and, thereby, configured to prevent (or otherwise reduce) image quality deteriorations.

Additional aspects will be set forth in the detailed description which follows and, in part, will be apparent from the disclosure, or may be learned by practice of the invention.

According to exemplary embodiments, a driving device of a display apparatus includes: a gate driver, a gate on voltage modulator, and a signal controller. The gate driver includes a plurality of gate driving circuits, each of the plurality of gate driving circuits being configured to: generate a gate signal according to a gate control signal, and apply the gate signal to at least one gate line. The gate on voltage modulator is configured to: modulate a gate on voltage according to a modulation control signal, and generate a first modulated gate on voltage. The signal controller is configured to generate the modulation control signal and the gate control signal. At least one of the plurality of gate driving circuits includes an amplifier configured to: receive the first modulated gate on voltage, and output a second modulated gate on voltage including substantially the same waveform as the first modulated gate on voltage.

According to exemplary embodiments, a driving device of a display apparatus includes: a gate driver and a signal controller. The gate driver includes a plurality of gate driving circuits, each of the plurality of gate driving circuits is configured to: generate a gate signal according to a gate control signal, and apply the gate signal to at least one gate line. The signal controller is configured to generate the gate control signal. At least one of the plurality of gate driving circuits includes a gate on voltage modulator configured to generate a modulated gate on voltage based on modulation of a gate on voltage according to a modulation control signal.

According to exemplary embodiments, a method to drive a display apparatus includes: receiving, at a gate driving circuit, a first modulated gate on voltage signal; receiving, at the gate driving circuit, a modified gate on voltage modified based on a spatial disposition of the gate driving circuit with respect to at least one other gate driving circuit; generating, based on the first modulated gate on voltage signal and a feedback voltage signal, a second modulated gate on voltage signal exhibiting a substantially similar waveform as the first modulated gate on voltage signal; and generating, based on the second modulated gate on voltage signal, at least one gate signal.

According to exemplary embodiments, a method to drive a display apparatus includes: receiving a modulation control signal comprising a high level and a low level; receiving a gate on voltage; receiving another voltage comprising a value between the gate on voltage and a gate off voltage, wherein when the modulation control signal is at the high level, the method further comprises: utilizing the gate on voltage to generate at least a portion of a gate signal, and wherein when the modulation control signal is at the low level, the method further comprises: utilizing a down pulse between the gate on voltage and the another voltage to generate at least another portion of the gate signal.

According to exemplary embodiments, it is possible to prevent (or otherwise reduce) deviations in a waveform of a gate on pulse according to a position of a gate driving circuit and, thereby, prevent (or otherwise reduce) distortions and/or degradations in image quality of an associated display apparatus.

The foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the principles of the invention.

DETAILED DESCRIPTION OF EXEMPLARY EMBODIMENTS

Figure 1:
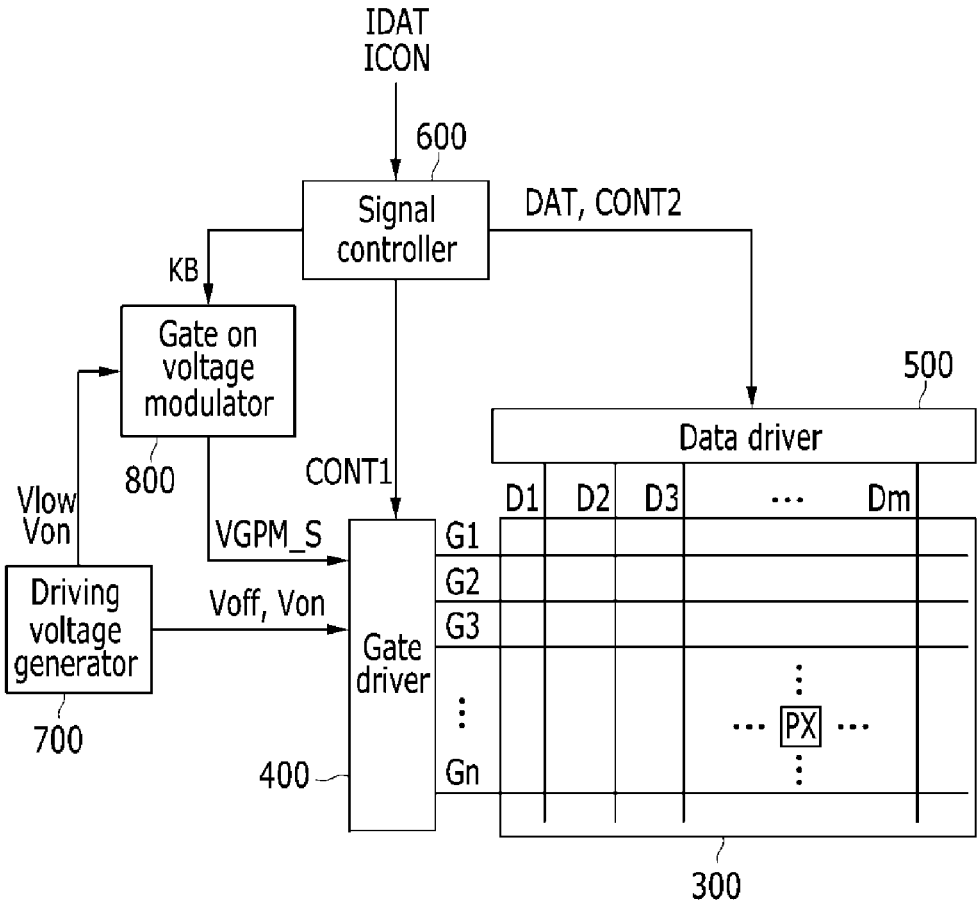
FIG. 1 is a block diagram of a display apparatus, according to exemplary embodiments.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments.

In the accompanying figures, the size and relative sizes of layers, films, panels, regions, etc., may be exaggerated for clarity and descriptive purposes. Also, like reference numerals denote like elements.

When an element or layer is referred to as being "on," "connected to," or "coupled to" another element or layer, it may be directly on, connected to, or directly coupled to the other element or layer or intervening elements or layers may be present. When, however, an element or layer is referred to as being "directly on," "directly connected to," or "directly coupled to" another element or layer, there are no intervening elements or layers present. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. Like numbers refer to like elements throughout. As used herein, the term "and/or" includes any and all combinations of one or more of the associated listed items.

Although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present disclosure.

Spatially relative terms, such as "beneath," "below," "lower," "above," "upper," and/or the like, may be used herein for descriptive purposes and, thereby, to describe one element or feature's relationship to another element(s) or feature(s) as illustrated in the drawings. Spatially relative terms are intended to encompass different orientations of an apparatus in use or operation in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations) and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and will not be interpreted in an idealized or overly formal sense, unless expressly so defined herein.

FIG. 1 is a block diagram of a display apparatus, according to exemplary embodiments.

Referring to FIG. 1, the display apparatus includes a display panel 300 and a driving device configured to drive the display panel 300. The driving device includes a gate driver 400, a data driver 500, a driving voltage generator 700, a gate on voltage modulator 800, and a timing (or signal) controller 600.

The display panel 300 may be (or include) a flat panel display (FPD), such as: a liquid crystal display (LCD), an organic light emitting diode (OLED) display, an electrophoretic display (EPD), an electrowetting display (EWD), a plasma display (PD), a field emission display (FED), etc. In the case of a liquid crystal display, the display panel 300 may include lower and upper panels (not illustrated) facing each other and a liquid crystal layer (not illustrated) disposed between the lower and upper panels, such as when viewed in a cross-sectional nature.

According to exemplary embodiments, the display panel 300 includes a plurality of signal lines and a plurality of pixels PX respectively connected to the plurality of signal lines. The plurality of pixels PX may be arranged in a matrix (or substantially matrix) form; however, other arrangements are contemplated and may be utilized.

The signal lines include a plurality of gate lines G1-Gn configured to transfer gate signals (also referred to as scanning signals) and a plurality of data lines D1-Dm configured to transfer data voltages.

Each pixel PX may include at least one switching element (not shown) connected to a corresponding one of the plurality of gate lines G1-Gn and a corresponding one of the plurality of data lines D1-Dm. At least one pixel electrode (not illustrated) may be connected to the corresponding one of the plurality of gate lines G1-Gn and the corresponding one of the plurality of data lines D1-Dm. The switching element may be (or include) at least one thin film transistor (not shown), and may be turned on or off according to an applied gate signal transferred by the corresponding gate line of the plurality of gate lines G1-Gn and, thereby, configured to selectively apply a data voltage transferred by the corresponding one of the plurality of data lines D1-Dm to the at least one pixel electrode. Each pixel PX may be configured to display an image including a corresponding luminance according to the data voltage applied to the at least one pixel electrode. It is also contemplated that the display apparatus may include one or more common electrodes (not illustrated), which may be associated with the plurality of pixels PX. Furthermore, the at least one pixel electrode and the one or more common electrodes may be suitably patterned, interlaced, and/or overlapped by one another.

To implement a color display, each pixel PX may be configured to display one of a plurality of primary colors (spatial division) or each pixel PX may alternately be configured to display one or more of the plurality of primary colors within a time window (temporal division) to, thereby, achieve a desired color by the spatial and temporal sum of the one or more presented primary colors. An example of the plurality of primary colors may include, for instance, three primary colors: such as red, green, and blue; however, it is contemplated that any number and/or range of colors may be utilized, whether primary or not. In exemplary embodiments, a plurality of adjacently disposed pixels PX that are configured to display different primary (or other) colors may be configured to form one set (referred to as one dot) together. One dot may be configured to display a white image.

The gate driver 400 is connected to the plurality of gate lines G1-Gn of the display panel 300. The gate driver 400 is configured to receive a gate control signal CONT1 from the signal controller 600, receive a modulated gate on voltage VGPM_S from the gate on voltage modulator 800, and receive a gate on voltage Von and a gate off voltage Voff from the driving voltage generator 700. In this manner, the gate driver 400 is further configured to generate a plurality of gate signals including gate on pulses based on the received signals/voltages and, thereby, configured to sequentially apply the plurality of gate signals to the plurality of gate lines G1-Gn.

The modulated gate on voltage VGPM_S may include a modified gate on voltage that is the same as or lower than the gate on voltage Von, as well as include a down pulse that is periodically shown. The down pulse may have a form that descends for a predetermined time from the modified gate on voltage to a "low" voltage that is lower than the modified gate on voltage, but higher than the gate off voltage Voff. However, the modulated gate on voltage VGPM_S is not limited thereto and may be (or include) various additional and/or alternative waveforms according to one or more conditions of the display panel 300.

For descriptive purposes, exemplary embodiments are described in association with an example in which the modulated gate on voltage VGPM_S includes a high level, that is, a modified gate on voltage, and a down pulse descending to a low voltage Vlow that is lower than the modified gate on voltage, but higher than the gate off voltage Voff.

The gate signal includes a gate off voltage Voff configured to turn off a switching element of a pixel PX, and at least one gate on pulse configured to turn on the switching element of the pixel PX. The gate on pulse may have a form that descends to the gate off voltage Voff from the low voltage Vlow that is descended from a high level voltage, that is, the modified gate on voltage of the modulated gate on voltage VGPM_S.

The gate control signal CONT1 includes a scanning start signal STV configured to instruct a scanning start of the gate signal, a gate clock signal CPV configured to control an output timing of the gate on pulse of the gate signal, at least one low voltage, and/or the like.

The data driver 500 is connected to the plurality of data lines D1-Dm of the display panel 300. The data driver 500 is configured to receive a data control signal CONT2 and an output image signal DAT from the signal controller 600, as well as configured to select a gray voltage corresponding to each output image signal DAT to convert the output image signal DAT to a data voltage, which is an analog data signal. The data control signal CONT2 includes a horizontal synchronization start signal configured to notify a transmission start of the output image signal DAT to those pixels PX in one row, a load signal configured to instruct that the data voltage is to be applied to the plurality of data lines D1-Dm, a data clock signal, and/or the like. The data control signal CONT2 may further include an inversion signal configured to invert a polarity of the data voltage for a common voltage Vcom (referred to as a polarity of the data voltage).

The data driver 500 is configured to supply a data voltage for a one (1) horizontal period to each of the plurality of data lines D1-Dm every one (1) horizontal period 1H when a gate on pulse is applied to each of the plurality of gate lines G1-Gn. In this manner, the data driver 500 may supply the data voltage to each of the plurality of data lines D1-Dm in response to an output enable signal DE.

The driving voltage generator 700 is configured to generate one or more driving voltages, such as a gate on voltage Von, a gate off voltage Voff, and a low voltage Vlow and, thereby, configured to supply the gate on voltage Von and the gate off voltage Voff to the gate driver 400, and the gate on voltage Von and the low voltage Vlow to the gate on voltage modulator 800. In addition, one or more driving voltages may be supplied to the data driver 500 and the signal controller 600.

The gate on voltage modulator 800 is configured to receive a modulation control signal KB from the signal controller 600 and to receive the gate on voltage Von and the low voltage Vlow from the driving voltage generator 700 and, thereby, configured to modulate the gate on voltage Von to generate a modulated gate on voltage VGPM_S. The modulated gate on voltage VGPM_S is supplied to the gate driver 400.

The signal controller 600 is configured to receive an input image signal IDAT and an input control signal ICON from a signal source and to generate various kinds of control signals to, thereby, control the gate driver 400, the data driver 500, the gate on voltage modulator 800, and the like.

According to exemplary embodiments, the respective driving devices may be directly installed on the display panel 300 in at least one IC chip form, adhered to the display panel 300 in a tape carrier package (TCP) form, or installed on a printed circuit board (not illustrated) that is to be connected to the display panel 300.

In exemplary embodiments, the gate driver 400, the data driver 500, the signal controller 600, the gate on voltage modulator 800, and/or the driving voltage generator 700 may be implemented via one or more general purpose and/or special purpose components, such as one or more discrete circuits, digital signal processing chips, integrated circuits, application specific integrated circuits, microprocessors, processors, programmable arrays, field programmable arrays, instruction set processors, and/or the like.

In association with driving the display apparatus, the signal controller 600 is configured to receive an input image signal IDAT and an input control signal ICON from, for instance, a signal source configured to control a display of the display apparatus. The input image signal IDAT includes luminance information associated with each pixel PX, and the luminance information includes (or is associated with) a predetermined number of grays (or gray scales). To this end, the input control signal ICON may be (or include) a vertical synchronization signal, a horizontal synchronizing signal, a main clock signal, a data enable signal, and/or the like.

The signal controller 600 is configured to process the input image signal IDAT based on the input image signal IDAT and the input control signal ICON to, thereby, convert the processed input image signal IDAT into an output image signal DAT and generate a gate control signal CONT1, a data control signal CONT2, and a modulation control signal KB. The signal controller 600 may transmit the gate control signal CONT1 to the gate driver 400, transmit the data control signal CONT2 and the output image signal DAT to the data driver 500, and transmit the modulation control signal KB to the gate on voltage modulator 800.

Accordingly, the data driver 500 is configured to receive the output image signal DAT for pixels PX in one row according to the data control signal CONT2 received from the signal controller 600, as well as configured to select a gray voltage corresponding to each output image signal DAT to, thereby, convert the output image signal DAT into an analog data voltage and apply the output image signal DAT to the corresponding plurality of data lines D1-Dm.

The gate driver 400 is configured to sequentially apply one or more gate on pulses to the plurality of gate lines G1-Gn according to the gate control signal CONT1 received from the signal controller 600 and, thereby, to turn on corresponding switching elements connected to the plurality of gate lines G1-Gn. The data voltage applied to the plurality of data lines D1-Dm is applied to the corresponding pixels PX via "turned-on" switching elements. When the data voltage is applied to a "tuned-on" pixel PX, the pixel PX may display luminance corresponding to the data voltage via various optical conversion elements (not shown). For example, in the case of a liquid crystal display, luminance corresponding to a gray scale of the input image signal IDAT may be displayed via control of an inclined degree (or rotation) of liquid crystal molecules of the liquid crystal layer and, thereby, control of the polarization of light or other form of illumination utilized in association with the presentation of an image via the pixel.

While the process is repeated by setting a one (1) horizontal period 1H as a unit, gate-on voltages Von are sequentially applied to all of the plurality of gate lines G1-Gn and data voltages are applied to all of the plurality of pixels PX to, thereby, display one or more image associated with one frame.

Figure 2:
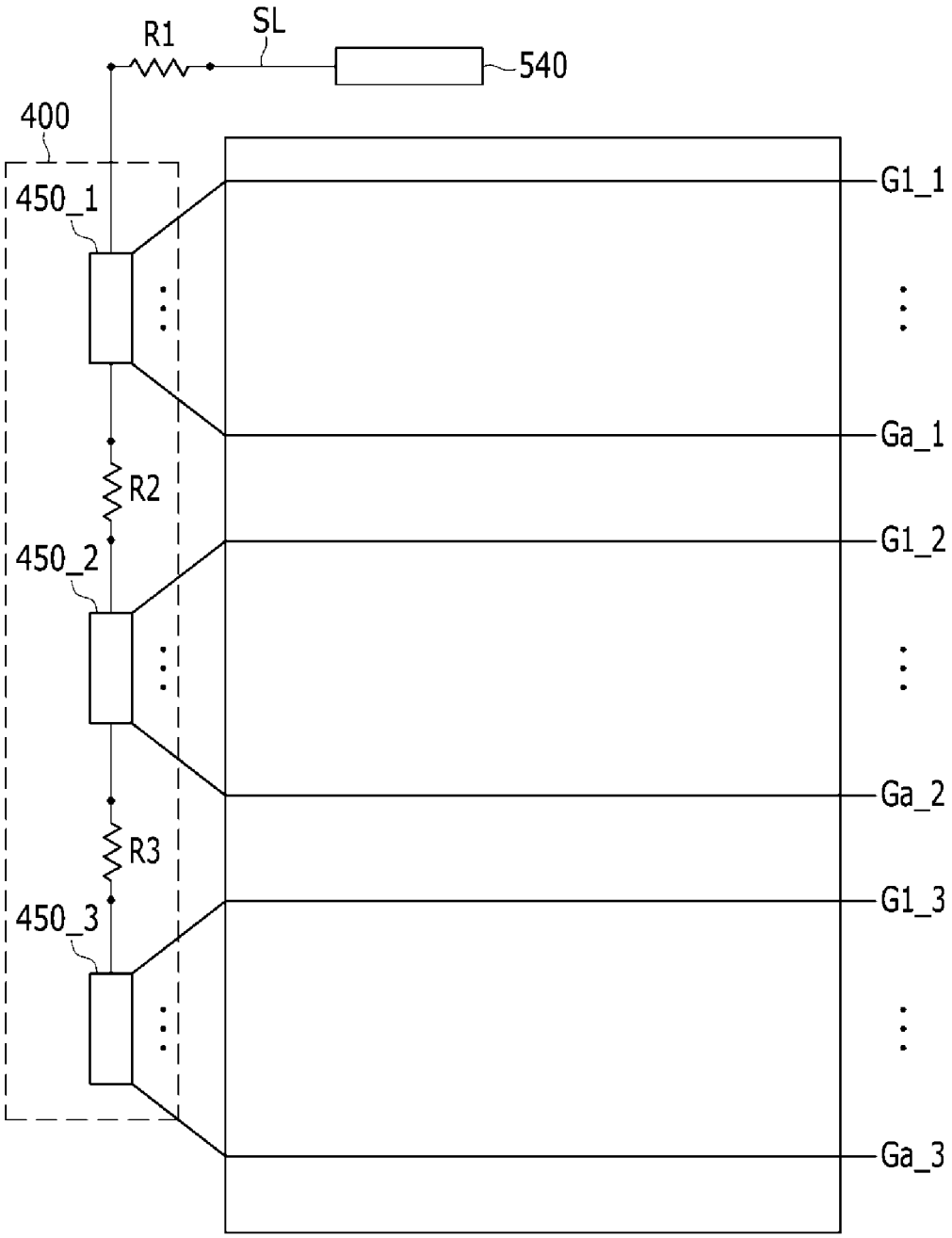
FIG. 2 is a layout view of the display apparatus of FIG. 1, according to exemplary embodiments.
Figure 3:
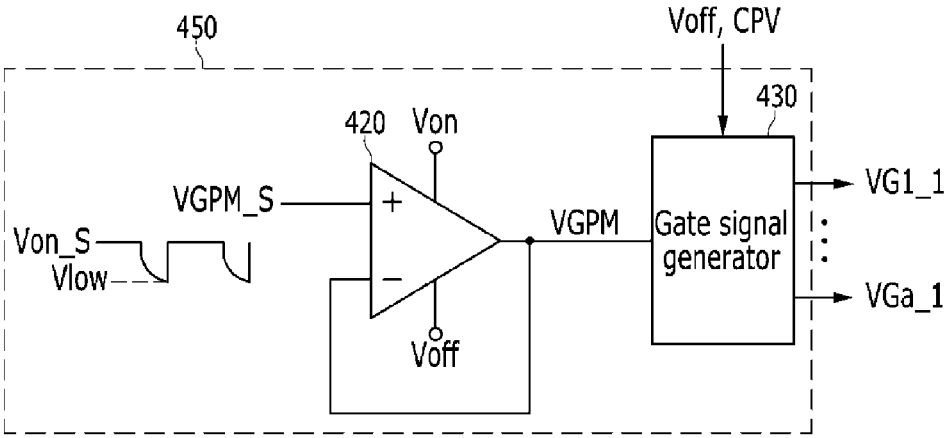
FIG. 3 is a block diagram of a gate driving circuit of a driving device of the display apparatus of FIG. 1, according to exemplary embodiments.
Figure 4:
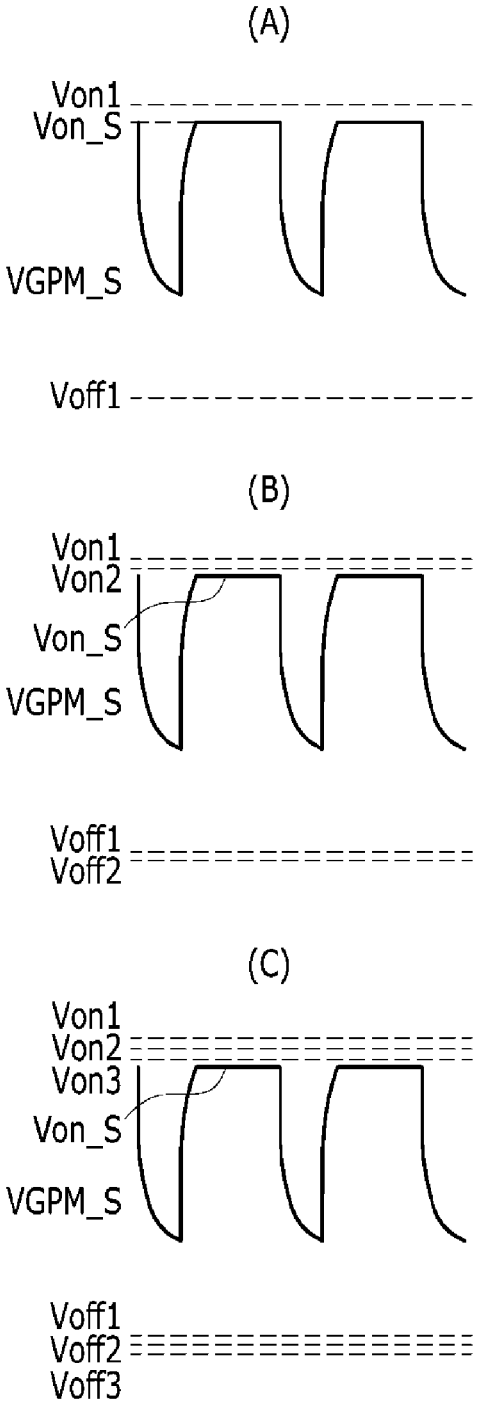
FIG. 4 is a waveform diagram of a plurality of gate on voltages input to a plurality of gate driving circuits and a plurality of modified gate on voltages, according to exemplary embodiments.

A driving device, e.g., a gate driver, of the display apparatus of FIG. 1 is described in more detail in association with FIGS. 2-4.

FIG. 2 is a layout view of the display apparatus of FIG. 1, according to exemplary embodiments. FIG. 3 is a block diagram of a gate driving circuit of a driving device of the display apparatus, according to exemplary embodiments. FIG. 4 is a waveform diagram of a plurality of gate on voltages input to a plurality of gate driving circuits and a plurality of modified gate on voltages, according to exemplary embodiments.

Referring to FIG. 2, the gate driver 400, according to exemplary embodiments, includes at least one gate driving circuit, such as gate driving circuits 450_1, 450_2, and 450_3. The respective gate driving circuits 450_1, 450_2, and 450_3 may be configured in at least one IC chip form. Although FIG. 2 illustrates a gate driver 400 including three gate driving circuits 450_1, 450_2, and 450_3, it is contemplated that any suitable number of gate driving circuits may be utilized. As shown, however, the gate driving circuits 450_1, 450_2, and 450_3 may be installed on the display panel 300 including a display area DA, the display area DA being an area of the display panel 300 configured to present images to an observer. Alternatively or additionally, the gate driving circuits 4501_1, 450_2, 450_3 may be installed on a printed circuit board (not illustrated) connected to the display panel 300.

The plurality of gate driving circuits 450_1, 450_2, and 450_3 is arranged in a line and each of the gate driving circuits 450_1, 450_2, and 450_3 are connected to a respective set of gate lines, e.g., a gate line set including gate lines G1_1-Ga_1, G1_2-Ga_2, and G1_3-Ga_3, which is driven by the respective gate lines. It is noted that "a" corresponds to a real integer. In this manner, although the illustrated exemplary embodiment depicts the same number of gate lines G1-Gn connected to the respective driving circuits 450_1, 450_2, and 450_3, it is contemplated that any suitable number of gate lines may be associated with the driving circuits 450_1, 450_2, and 450_3 and each driving circuit may be associated with a different number of gate lines than one or more of the other driving circuits.

According to exemplary embodiments, the gate driving circuits 450_1, 450_2, and 450_3 may be configured to receive various driving signals, such as the gate on voltage Von, the gate off voltage Voff, the modulated gate on voltage VGPM_S, and the gate control signal CONT1, via a signal wiring line SL connected to a data driving circuit 540 included as part of (or associated with) the data driver 500 or a flexible printed circuit film installed on the data driving circuit 540. In this manner, an amount (or degree) of delay of an associated driving signal input to the respective gate driving circuits 450_1, 450_2, and 450_3 may be different from each other due to a load associated with resistors R1, R2, and R3 the signal wiring line SL. For example, levels of gate on voltages Von input to the respective gate driving circuits 450_1, 450_2, and 450_3 may be lowered by a voltage drop along the signal wiring line SL due to the presence of the resistors R1, R2, and R3, which may be disposed between respective ones of the gate driving circuits 450_1, 450_2, and 450_3 or between one of the gate driving circuits (e.g., gate driving circuit 450_1) and the data driving circuit 540.

Referring to FIG. 3, each of the gate driving circuits 450_1, 450_2, and 450_3 includes an amplifier 420 and a gate signal generator 430. In order to avoid obscuring exemplary embodiments described herein, the respective gate driving circuits 450_1, 450_2, and 450_3 will be collectively described in association with a representative gate driving circuit 450.

According to exemplary embodiments, two power terminals of the amplifier are configured to receive the gate on voltage Von and the gate off voltage Voff, respectively, and a non-inversion input terminal (e.g., the positive "+" terminal) is configured to receive the modulated gate on voltage VGPM_S from, for instance, the gate on voltage modulator 800, whereas an inversion input terminal (e.g., the negative "−" terminal) is connected to an output terminal to feedback an output voltage of the amplifier 420. The modulated gate on voltage VGPM_S may include a down pulse that periodically descends to a low voltage Vlow from a high level, that is, a modified gate on voltage Von_S as described above.

Gate on voltages Von input to upper power terminals of the respective gate driving circuits 450_1, 450_2, and 450_3 may be different from each other according to respective positions of the gate driving circuits 450_1, 450_2, and 450_3.

Referring to FIG. 4A, a first gate driving circuit 450_1 may be configured to receive a gate on voltage Von of a first on level Von1 that is lower than a level of the gate on voltage Von of the data driving circuit 540. The difference between the first on level Von1 and the gate on voltage Von may be the result of a voltage drop associated with the resistor R1 disposed between the first gate driving circuit 450_1 and the data driving circuit 540.

Referring to FIG. 4B, a second gate driving circuit 450_2 may be configured to receive a gate on voltage Von of a second on level Von2 that is lower than the first on level Von1. The difference between the first on level Von1 and the second on level Von2 may be the result of a voltage drop associated with the resistors R1 and R2 disposed between the second gate driving circuit 450_2 and the data driving circuit 540.

Referring to FIG. 4C, a third gate driving circuit 450_3 may be configured to receive a gate on voltage Von of a third on level Von3 that is lower than the second on level Von2. The difference between the second on level Von2 and the third on level Von3 may be the result of a voltage drop associated with the resistors R1, R2, and R3 disposed between the third gate driving circuit 450_3 and the data driving circuit 540.

Adverting back to FIG. 3 and with continued reference to FIG. 4, the gate off voltages Voff input to lower power terminals of the respective amplifiers 420 of the gate driving circuits 450_1, 450_2, and 450_3 may have a first off level Voff1, a second off level Voff2, and a third off level Voff3 that are respectively lower in value, e.g., Voff1>Voff2>Voff3.

According to exemplary embodiments, the amplifier 420 is configured to output a modulated gate on voltage VGPM exhibiting the same waveform as the received modulated gate on voltage VGPM_S. In this manner, the high level of the modulated gate on voltage VGPM and the high level of the received modulated gate on voltage VGPM_S may be set to become modified gate on voltages Von_S that are lower than the gate on voltages Von received from the driving voltage generator 700. As such, the modulated gate on voltage VGPM, which is output by maintaining an offset of the gate on voltage Von input to the upper power terminal of the amplifier 420, may exhibit a predetermined high level for each respective gate driving circuit 450.

According to exemplary embodiments, a value of the modified gate on voltage Von_S may be smaller than the third on level Von3 of the gate on voltage Von input to the "last" gate driving circuit (e.g., third gate driving circuit 450_3) that is configured to receive a gate on voltage Von including the lowest level. Accordingly, as illustrated in FIG. 4, the high level of the received modulated gate on voltage VGPM_S input to each of the gate driving circuits 450_1, 450_2, and 450_3, that is, the modified gate on voltage Von_S, may be lower than the lowest on level voltage (e.g., the third on level Von3 voltage) among the levels of the gate on voltages Von input to the gate driving circuits 450_1, 450_2, and 450_3. Further, since the received modulated gate on voltage VGPM_S input to each of the gate driving circuits 450_1, 450_2, and 450_3 is input as a signal, the received modulated gate on voltage VGPM_S will not be influenced by a signal delay due to the resistor(s) of the signal wiring line SL and a load of a parasitic capacitor, and/or the like. As a result, the high levels of the modulated gate on voltages VGPM output by the amplifiers 420 of the gate driving circuits 450_1, 450_2, and 450_3 may be the same as each other regardless of a difference between the power levels input to the power terminal of each amplifier 420. In this manner, the output waveforms thereof may also be the same as each other.

In exemplary embodiments, the gate signal generator 430 is configured to receive the modulated gate on voltage VGPM output from the amplifier 420, as well as configured to receive the gate off voltage Voff output from the driving voltage generator 700 and the gate control signal CONT1, such as the gate clock signal CPV, from the signal controller 600. Based on these received signals, the gate signal generator 430 is configured to generate a plurality of gate signals VG1_1-VGa_1 and apply the generated plurality of gate signals VG1_1-VGa_1 respectively to the plurality of gate lines G1_1-Ga-1 connected to the gate driving circuit 450. The plurality of gate signals VG1_1-VGa_1 include a gate off voltage Voff and at least one gate on pulse, and each gate on pulse may include the high level of the modulated gate on voltage VGPM, that is, the modified gate on voltage Von_S and the down pulse that descends to the low voltage Vlow from the modified gate on voltage Von_S.

Figure 5:
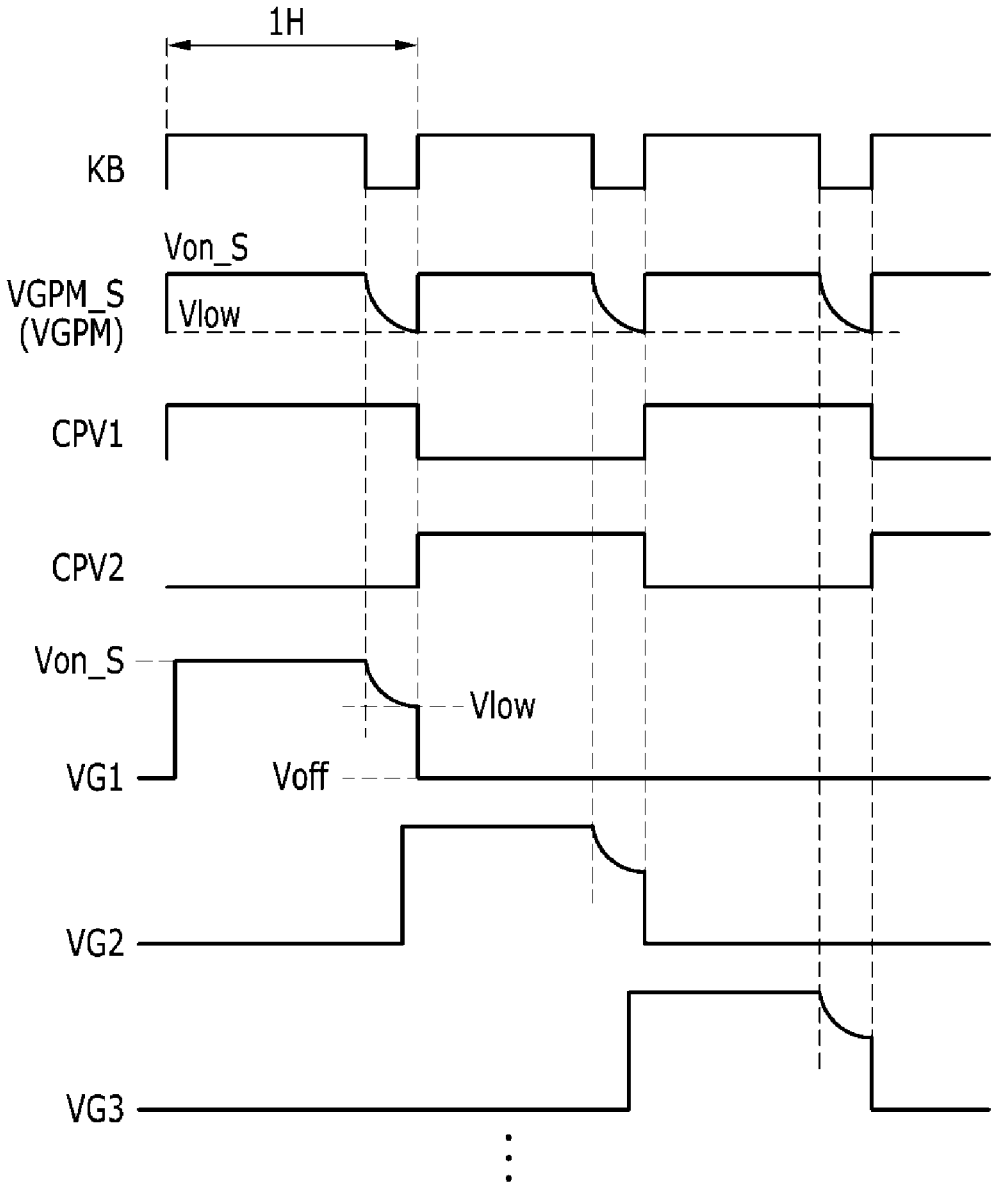
FIG. 5 is a timing diagram of various driving signals, according to exemplary embodiments.

A driving method of the display apparatus including one or more gate driving circuits is described in more detail in association with FIG. 5.

FIG. 5 is a timing diagram of various driving signals, according to exemplary embodiments.

Referring to FIG. 5, the gate on voltage modulator 800 is configured to receive the modulation control signal KB from the signal controller 600. The modulation control signal KB may include a down pulse represented by a one (1) horizontal period 1H. The gate on voltage modulator 800 is configured to modulate a gate on voltage Von to generate the modulated gate on voltage VGPM_S. The modulated gate on voltage VGPM_S is configured to maintain the modified gate on voltage Von_S while the modulation control signal KB has a high level, and may include a down pulse that descends to the low voltage Vlow in synchronization with the start of the down pulse of the modulation control signal KB. In this manner, the descent of the modulated gate on voltage VGPM_S to the low voltage Vlow may occur over the duration of the time when the modulation control signal KB exhibits the low level. The down pulse of the modulated gate on voltage VGPM_S may also be represented by a one (1) horizontal period 1H.

The generated modulated gate on voltage VGPM_S is input to each gate driving circuit 450 of the gate driver 400. The gate driving circuit 450 is configured to receive at least one gate clock signal CPV from the signal controller 600 and, thereby, configured to generate a gate signal based thereon. As seen in FIG. 5, the gate clock signal CPV includes a plurality of gate clock signals (e.g., two gate clock signals CPV1 and CPV2) that are inverted with one another. High levels or low levels of the two gate clock signals CPV1 and CPV2 may be maintained for the 1 horizontal period 1H.

The gate driving circuit 450 may generate a gate signal using the modulated gate on voltage VGPM including the same level and waveform as the modulated gate on voltage VGPM_S as described above. The gate driving circuit 450 may output at least one gate on pulse including the modulated gate on voltage VGPM, while the input gate clock signals CPV1 and CPV2 exhibit the high levels or the low levels. To this end, the gate driving circuit 450 may output the gate off voltage Voff for the remaining period of time. Each gate on pulse may be output for an approximately one (1) horizontal period 1H.

As such, a plurality of gate signals VG1, VG2, VG3, . . . , VGn may be configured to include gate on pulses that are sequentially output to the plurality of gate lines G1-Gn connected to the gate driving circuit 450.

According to exemplary embodiments, since the output waveforms and levels of the modulated gate on voltage VGPM output from the respective amplifiers 420 of each gate driving circuit 450 is the same (or substantially the same) as each other, waveforms and levels of the gate on pulse of the gate signal output to the plurality of gate lines G1-Gn by the plurality of gate driving circuits 450 may be the same (or substantially the same) as each other. Particularly, since a discharging path is connected to the low power terminal of the respective amplifiers 420 when the down pulse of the modulated gate on voltage VGPM is generated, gate on pulses having the same waveform may be generated for each of the plurality of gate driving circuits 450.

The effects of such a configuration and driving method will be described with reference to FIGS. 6A-6C associated with a conventional display apparatus and FIGS. 7A-7C associated with an exemplary display apparatus, along with continued reference to FIG. 3.

Figure 6A:
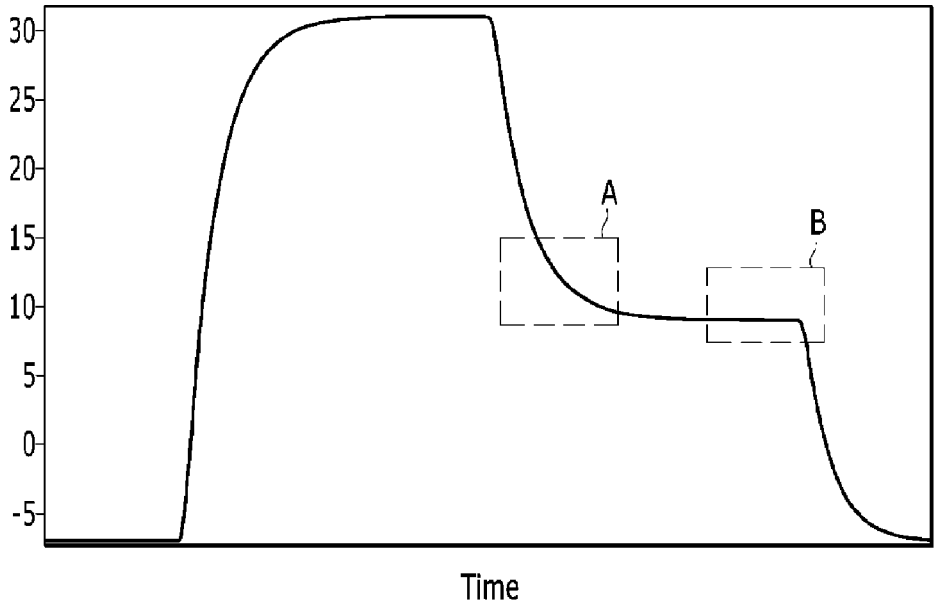
FIG. 6A is a graph of a conventional output waveform of a gate driving circuit.
Figure 6B:
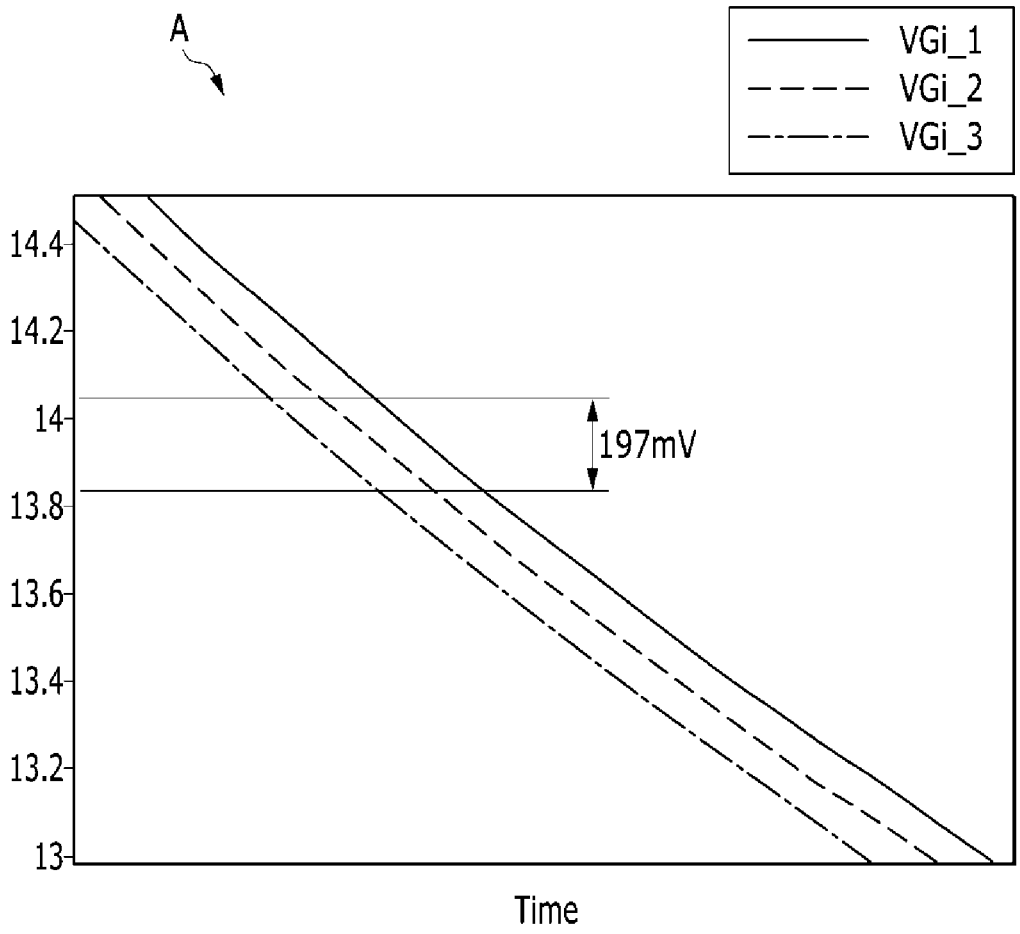
FIG. 6B is an enlarged graph of portion A of FIG. 6A.
Figure 6C:
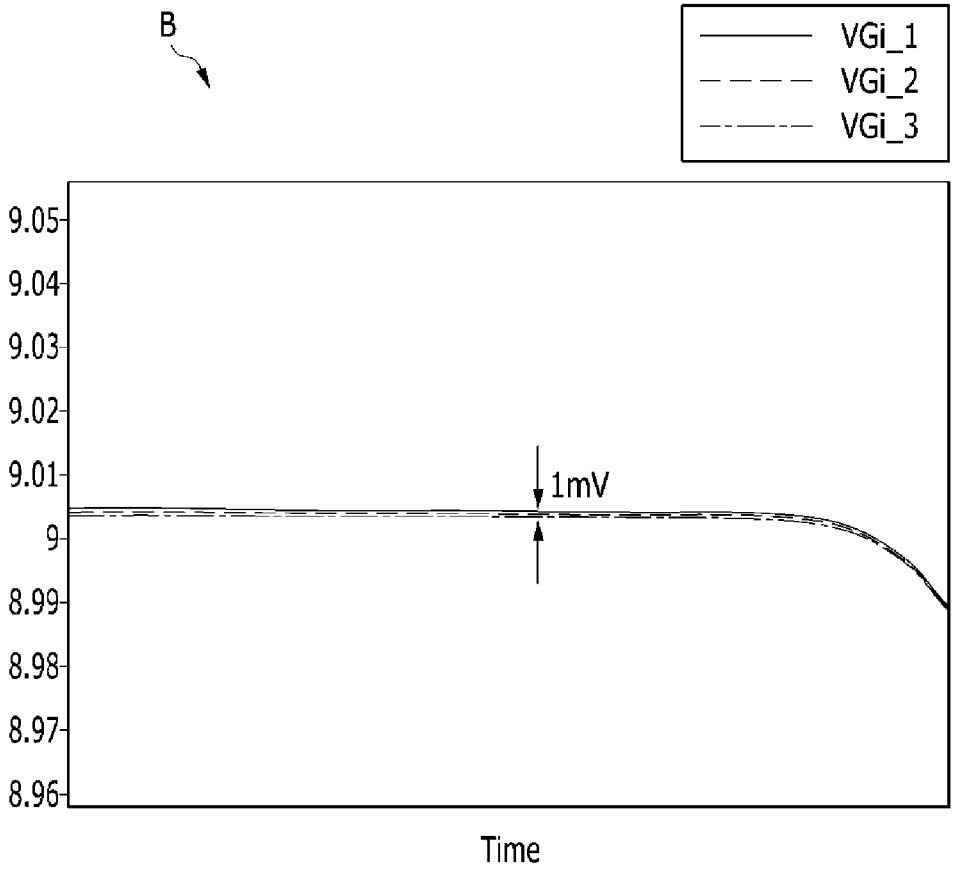
FIG. 6C is an enlarged graph of portion B of FIG. 6A.
Figure 7A:
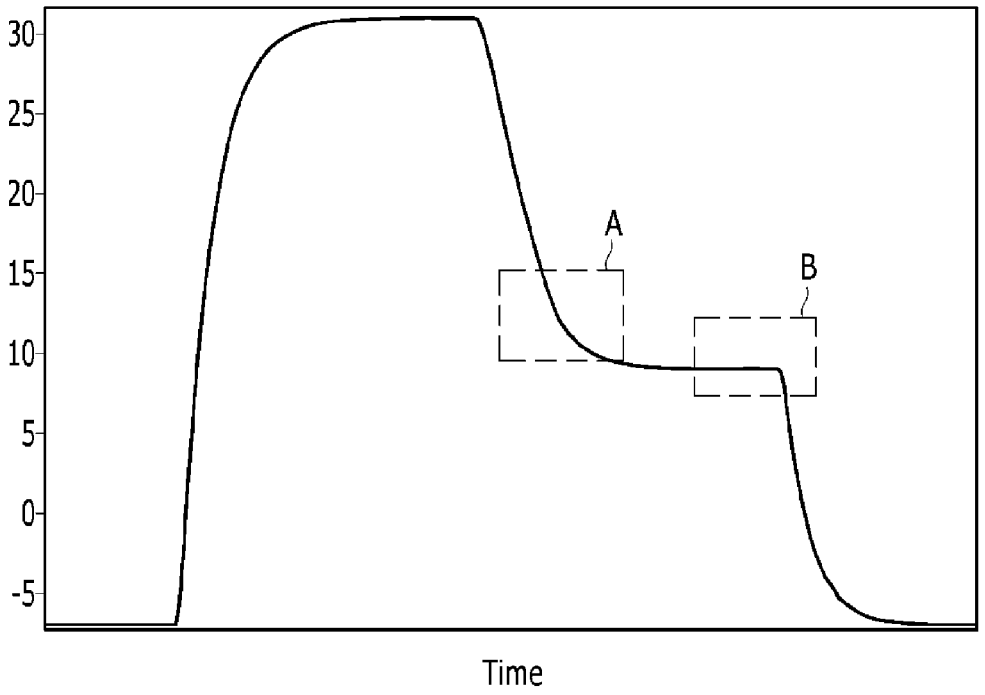
FIG. 7A is a graph of an output waveform of a gate driving circuit, according to exemplary embodiments.

FIG. 6A is a graph of a conventional output waveform of a driving circuit. FIGS. 6B and 6C are enlarged graphs of respective portions A and B of FIG. 6A. FIG. 7A is a graph of an output waveform of a driving circuit, according to exemplary embodiments. FIGS. 7B and 7C are enlarged graphs of respective portions A and B of FIG. 7A, according to exemplary embodiments.

For example, when the gate driver 400 includes the first to third gate driving circuits 450_1, 450_2, and 450_3, the first gate driving circuit 450_1 is configured to output a gate signal VGi_1 to a first gate line Gi_1, the second gate driving circuit 450_2 is configured to output a gate signal VGi_2 to a second gate line Gi_2 corresponding to the gate line Gi_1, and the third gate driving circuit 450_3 is configured to output a gate signal VGi_3 to a third gate line Gi_3 corresponding to the gate line Gi_1. In this manner, a difference between gate signals output to the first and third gate driving circuits 450_1 and 450_3, which are disposed farthest away from each other is largest at a portion A where a change in the gate signal is largest (for example, 197 mV, in a conventional display apparatus, as seen in FIG. 6B). On the contrary, a difference in a gate signal output between the gate driving circuits 450_1, 450_2, and 450_3 may not be large at a portion B where a change in the gate signal is small, e. g., 1 mV in a conventional display apparatus, as seen in FIG. 6C.

Figure 7B:
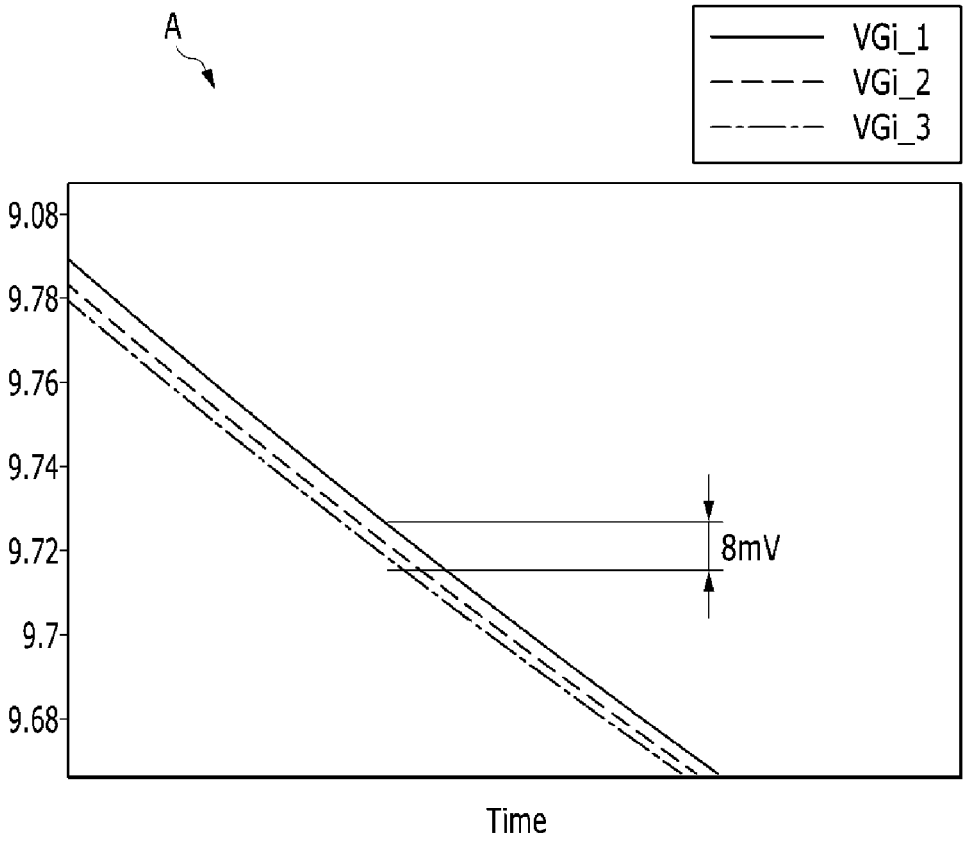
FIG. 7B is an enlarged graph of portion A of FIG. 7A, according to exemplary embodiments.
Figure 7C:
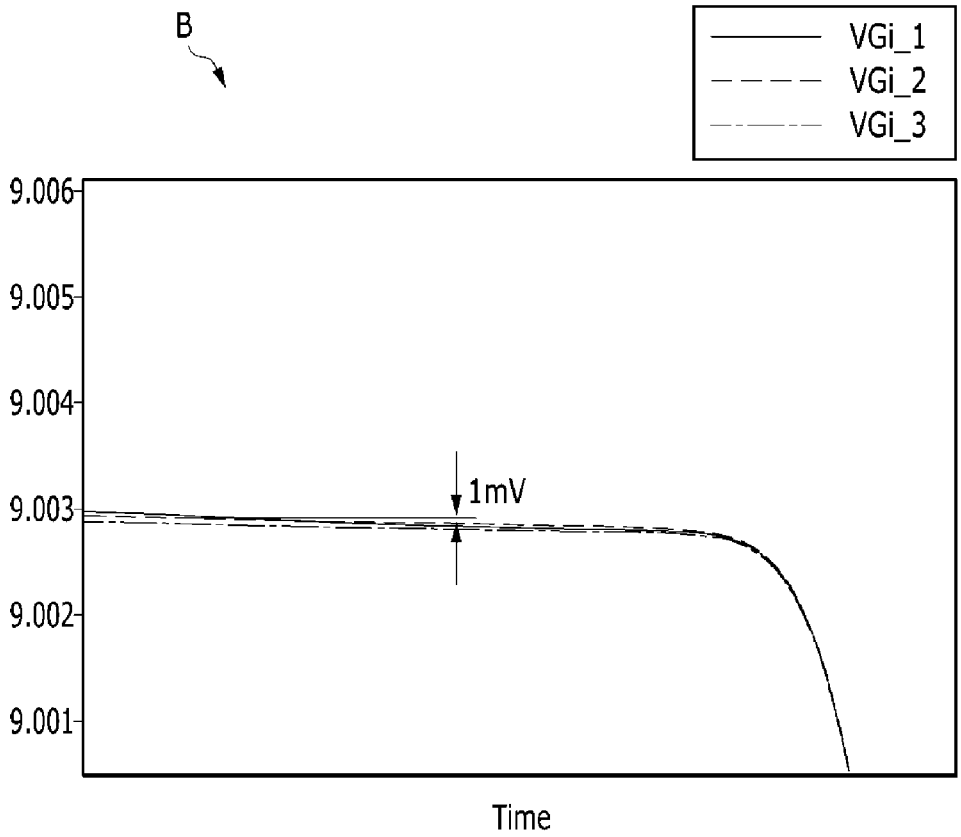
FIG. 7C is an enlarged graph of portion B of FIG. 7A, according to exemplary embodiments.

Meanwhile, according to exemplary embodiments, as illustrated in FIG. 7B, the difference in the gate signal output between the first and third gate driving circuits 450_1 and 450_3 may not be large even at the portion A where the change of the gate signal is large (for example, 8 mV). The value is not largely different from the difference (about 1 mV) in the gate signal output between the gate driving circuits 450_1, 450_2, and 450_3 at the portion B where the change in the gate signal is small. There is little difference in the gate signal output between the gate driving circuits 450_1, 450_2, and 450_3 even at the portion B where the change of the gate signal is small.

As such, according to exemplary embodiments, since the gate on pulses having the same (or substantially the same) waveform or the same (or substantially the same) level may be output at a plurality of gate driving circuits 450 despite relative differences in their spatial positioning. As such, it is possible to prevent image quality from being deteriorated according to a deviation of the waveforms of the gate on pulses.

Figure 8:
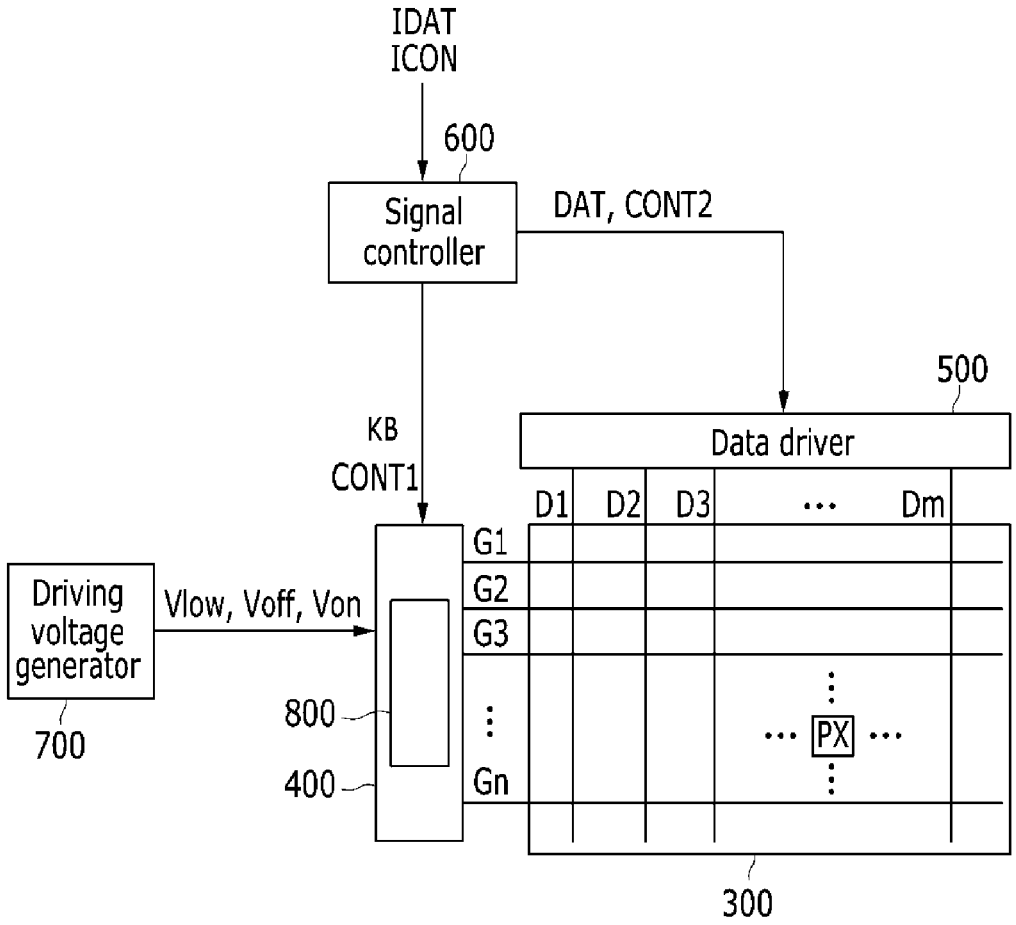
FIG. 8 is a block diagram of a display apparatus, according to exemplary embodiments.

Another display apparatus, according to exemplary embodiments, is described in association with FIG. 8. In this manner, it is noted that similarly configured constituent components of the display apparatus of FIG. 8 are similarly numbered as in the display apparatus of FIG. 1. To avoid obscuring exemplary embodiments described herein, repetitive description of similarly numbered constituent components has been omitted.

FIG. 8 is a block diagram of a display apparatus, according to exemplary embodiments.

Referring to FIG. 8, a display apparatus includes a display panel 300, a gate driver 400, a data driver 500, a driving voltage generator 700, and a gate on voltage modulator 800. The display apparatus also includes a signal controller 600. As previously mentioned, the gate driver 400, the data driver 500, the signal controller 600, the gate on voltage modulator 800, and/or the driving voltage generator 700 may be implemented via one or more general purpose and/or special purpose components, such as one or more discrete circuits, digital signal processing chips, integrated circuits, application specific integrated circuits, microprocessors, processors, programmable arrays, field programmable arrays, instruction set processors, and/or the like.

The gate driver 400 of the display apparatus may be embedded in the gate on voltage modulator 800. Namely, at least one gate driving circuit 450 included in the gate driver 400 may include the gate on voltage modulator 800 as described above to directly generate a modulated gate on voltage VGPM in the gate driving circuit 450. Accordingly, since the modulated gate on voltage VGPM is not influenced by a signal delay due to the resistor(s) of the signal wiring line SL when a down pulse of the modulated gate on voltage VGPM is generated, pulse waveforms and levels of the modulated gate on voltages VGPM generated by the respective gate driving circuits 450 may be the same (or substantially the same) as each other.

Figure 9:
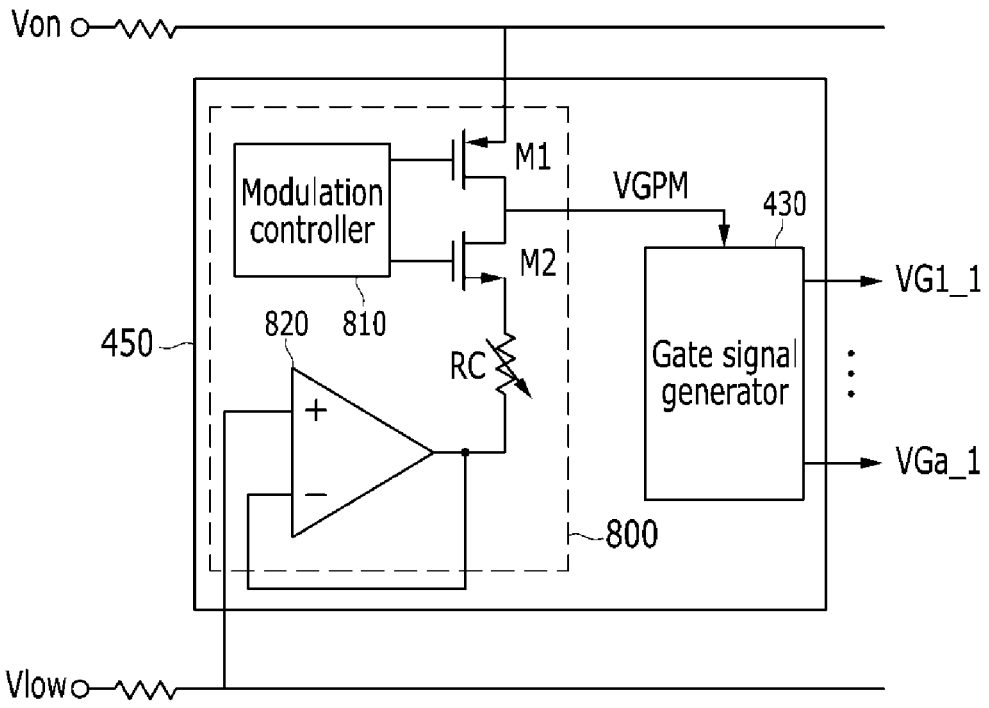
FIG. 9 is a block diagram of a gate driving circuit of a driving device of the display device of FIG. 8, according to exemplary embodiments.

The gate driver 400 of FIG. 8 is described in more detail in association with FIG. 9, as well as the waveform diagram of FIG. 5.

FIG. 9 is a block diagram of a gate driving circuit of a driving device of the display apparatus of FIG. 8, according to exemplary embodiments.

Referring to FIG. 9, a gate driving circuit 450 includes the gate on voltage modulator 800 and a gate signal generator 430 connected thereto.

The gate on voltage modulator 800 may include a modulation controller 810, a first transistor M1, a second transistor M2, and an amplifier 820.

The modulation controller 810 is configured to receive a modulation control signal KB from the signal controller 600 to, thereby, control the first and second transistors M1 and M2.

The first transistor M1 and the second transistor M2 may be field effect transistors FET.

A source terminal of the first transistor M1 is connected to a gate on voltage Von, a gate terminal is connected to the modulation controller 810, and a drain terminal is connected to the gate signal generator 430, as well as the drain terminal of the second transistor M2. The first transistor M1 may be an n-type transistor.

A drain terminal of the second transistor M2 is connected to the drain terminal of the first transistor M1, a gate terminal is connected to the modulation controller 810, and a source terminal is connected to an output terminal of the amplifier 820. The second transistor M2 may be a p-type transistor.

The amplifier 820 includes a non-inversion input terminal (e.g., a positive "+" terminal) configured to receive a low voltage Vlow and an output terminal connected to the source terminal of the second transistor M2, and an inversion input terminal (e.g., a negative "–" terminal) of the amplifier 820 is connected to an output terminal to feedback an output voltage. A variable resistor RC may be connected between the second transistor M2 and the output terminal of the amplifier 820.

An operation of the gate on voltage modulator 800 is described in more detail in association with FIGS. 5-9.

The first transistor M1 is conducted (e.g., "turned-on") and the second transistor M2 is interrupted (e.g., "turned-off") while the modulation control signal KB input from the signal controller 600 is at a high level. As such, the gate on voltage Von is output to the gate signal generator 430 via the first transistor M1. When the modulation control signal KB is changed to a low level, the first transistor M1 is interrupted (e.g., "turned-off") and the second transistor M2 is conducted (e.g., "turned-on"). As such, a voltage charged in an equivalent capacitor (not illustrated) connected to the drain terminal of the first transistor M1 is discharged to the source terminal of the second transistor M2 and a down pulse of the modulated gate on voltage VGPM is generated as illustrated in FIG. 5 and, thereby, output to the gate signal generator 430. A slope of the down pulse of the modulated gate on voltage VGPM may be controlled via adjusting the variable resistor RC of the gate on voltage modulator 800.

As described above, the gate signal generator 430 is configured to receive the generated modulated gate on voltage VGPM to, thereby, generate the plurality of gate signals VG1_1-VGa_1 as described above, as well as to output the generated plurality of gate signals VG1_1-VGa_1 to the plurality of gate lines G1_1-Ga_1 connected to the gate driving circuit 450.

While certain exemplary embodiments and implementations have been described herein, other embodiments and modifications will be apparent from this description. Accordingly, the invention is not limited to such embodiments, but rather to the broader scope of the presented claims and various obvious modifications and equivalent arrangements.

What is claimed is:

1. A driving device of a display apparatus, comprising:

a gate driver comprising a plurality of gate driving circuits, each of the gate driving circuits being configured to:

generate a gate signal according to a gate control signal, and apply the gate signal to at least one gate line;

a gate on voltage modulator configured to modulate a gate on voltage according to a modulation control signal to generate a first modulated gate on voltage; and a signal controller configured to generate the modulation control signal and the gate control signal, wherein at least one of the plurality of gate driving circuits comprises an amplifier, the amplifier comprising:

a first power terminal configured to receive the gate on voltage, a second power terminal configured to receive a gate off voltage, a first input terminal configured to receive the first modulated gate on voltage, an output terminal configured to output a second modulated gate on voltage comprising substantially the same waveform as the first modulated gate on voltage, and a second input terminal connected to the output terminal via a negative feedback loop.

2. The driving device of a display apparatus of claim 1, further comprising:

a gate signal generator configured to:

receive the second modulated gate on voltage, generate the gate signal comprising a gate off voltage and at least one gate on pulse, and output the generated gate signal to the at least one gate line.

3. The driving device of a display apparatus of claim 2, wherein:

each of the plurality of gate driving circuits is configured to receive a corresponding first modulated gate on voltage; and each of the corresponding first modulated gate on voltages respectively input to the plurality of gate driving circuits comprises substantially the same waveform.

4. The driving device of a display apparatus of claim 3, wherein a high level of the first modulated gate on voltage is lower than the gate on voltage input to the first power terminal of the amplifier.

5. The driving device of a display apparatus of claim 4, further comprising:

a data driving circuit configured to apply at least one data voltage to at least one data line, wherein the high level of the first modulated gate on voltage is lower than the gate on voltage input to the first power terminal of the gate driving circuit disposed farthest away from the data driving circuit.

6. The driving device of a display apparatus of claim 5, wherein:

the first modulated gate on voltage comprises a down pulse that descends from the high level to a low voltage in synchronization with the modulation control signal.

7. The driving device of a display apparatus of claim 6, wherein:

the low voltage comprises a value between the gate on voltage and the gate off voltage.

8. The driving device of a display apparatus of claim 7, wherein:

the gate signal generator is configured to generate the gate signal based on at least one gate clock signal.

9. The driving device of a display apparatus of claim 1, wherein a high level of the first modulated gate on voltage is lower than the gate on voltage input to the first power terminal of the amplifier.

10. The driving device of a display apparatus of claim 9, further comprising:

a data driving circuit configured to apply at least one data voltage to at least one data line, wherein the high level of the first modulated gate on voltage is lower than the gate on voltage input to the first power terminal of the gate driving circuit disposed farthest away from the data driving circuit.

11. A driving device of a display apparatus, comprising:

a gate driver comprising a plurality of gate driving circuits, each of the plurality of gate driving circuits being configured to:

generate a gate signal according to a gate control signal, and apply the gate signal to at least one gate line; and a signal controller configured to generate the gate control signal, wherein at least one of the plurality of gate driving circuits comprises a gate on voltage modulator configured to generate a modulated gate on voltage based on modulation of a gate on voltage according to a modulation control signal, and wherein the gate on voltage modulator comprises:

a first transistor configured to receive the gate-on voltage;

a second transistor connected to the first transistor, the second transistor being configured to receive output of an amplifier;

a modulation controller configured to control the first and second transistors according to the modulation control signal; and the amplifier comprising:

a first input terminal configured to receive a low voltage comprising a value between the gate on voltage and a gate off voltage;

an output terminal connected to the second transistor; and a second input terminal connected to the output terminal via a negative feedback loop.

12. The driving device of a display apparatus of claim 11, further comprising:

a gate signal generator configured to:

receive the modulated gate on voltage, generate the gate signal comprising the gate off voltage and at least one gate on pulse, and output the generated gate signal to the at least one gate line.

13. The driving device of a display apparatus of claim 12, wherein:

when the modulation control signal is in a first state, the first transistor is turned-on, the second transistor is turned-off, and the gate on voltage is output to the gate signal generator; and when the modulation control signal is in a second state different from the first state, the first transistor is turned-off, the second transistor is turned-on, and a down pulse that descends from the gate on voltage is output to the gate signal generator.

14. The driving device of a display apparatus of claim 13, further comprising:

a variable resistor connected between the second transistor and the amplifier.

15. The driving device of a display apparatus of claim 14, wherein:

the gate signal generator is connected to a contact point between the first transistor and the second transistor.

16. The driving device of a display apparatus of claim 15, wherein the gate signal generator is configured to generate the gate signal based on at least one gate clock signal.

17. The driving device of a display apparatus of claim 12, wherein the gate signal generator is connected to a contact point between the first transistor and the second transistor.

18. The driving device of a display apparatus of claim 11, further comprising:

a variable resistor connected between the second transistor and the amplifier.

19. The driving device of a display apparatus of claim 11, wherein:

the signal controller is further configured to generate the modulation control signal; and the gate on voltage modulator is further configured to receive the modulation control signal from the signal controller.

* * * * *